US005123406A

United States Patent [19]

Masuda

[11] Patent Number: 5,123,406

[45] Date of Patent: Jun. 23, 1992

[54] MOTOR-DRIVEN MASSAGING APPARATUS

[75] Inventor: Isamu Masuda, Fukuoka, Japan

[73] Assignee: Nihonkenkozoshinkenkyukai Co., Ltd., Fukuoka, Japan

[21] Appl. No.: 465,153

[22] Filed: Mar. 8, 1990

[51] Int. Cl.[5] ..... A61H 15/00

[52] U.S. Cl. ..... 128/57; 128/24.3; 128/36

[58] Field of Search ..... 128/57, 44, 36, 35, 128/34, 32, 24.3; 30/500, DIG. 1; 429/164, 96

[56] References Cited

U.S. PATENT DOCUMENTS

| | | | |
|---|---|---|---|
| 2,963,598 | 12/1960 | Kent | 30/DIG. 1 |
| 3,636,627 | 1/1972 | Tiffin | 30/DIG. 1 |
| 3,675,324 | 7/1972 | Yamada et al. | 30/DIG. 1 |
| 3,705,578 | 12/1972 | Cutler et al. | 128/36 |
| 3,779,238 | 12/1973 | Cutler et al. | 128/36 |
| 3,845,758 | 11/1974 | Anderson | 128/57 X |
| 4,669,452 | 6/1987 | Osawa | 128/36 |
| 4,878,489 | 11/1989 | Kamayachi | 128/36 |
| 4,949,464 | 8/1990 | Adomatis | 30/DIG. 1 |

FOREIGN PATENT DOCUMENTS

| | | | |
|---|---|---|---|
| 0423993 | 3/1967 | Japan | 128/32 |
| 0146655 | 7/1984 | Japan | 128/32 |

*Primary Examiner*—Robert A. Hafer
*Assistant Examiner*—Brian E. Hanlon
*Attorney, Agent, or Firm*—Jordan and Hamburg

[57] ABSTRACT

A motor-driven massaging apparatus obtains a massaging effect by applying pressure and vibration to a human body. The motor-driven massaging apparatus includes a finger-pressure roller which incorporates a DC-driven vibrator therein and operating handles project from both sides of the finger-pressure roller. A power supply part having batteries as a driving source is installed in the handle, and the vibrator is connected electrically to the power supply part. Batteries are used as a source of driving the vibrator, and therefore the location of use in not limited, and no connection of a cord is necessary.

10 Claims, 4 Drawing Sheets

MOTOR-DRIVEN MASSAGING APPARATUS

TECHNICAL FIELD

The present invention relates to a motor-driven massaging apparatus for massaging by acting pushing pressure and vibration on a human body, and specifically the present invention relates to a motor-driven massaging apparatus having a construction that a finger-pressure roller incorporating a vibration is disposed rotatably on a operating handles.

BACKGROUND ART

For the conventional motor-driven massaging apparatus, the one has been used which has a construction that a vibration is incorporated inside a finger-pressure roller.

The above-mentioned vibrator is constituted in a manner that an eccentric member is attached to an output shaft of a DC motor, and when the DC motor is driven from a DC power source, the eccentric member is rotated and vibration is generated. The finger-pressure roller is disposed rotatably on operating handles, and a cord is drawn out from one of the right and left operating handles, and an attachment plug provided with an adaptor is attached to the tip of this cord.

Thus, when this attachment plug is inserted into a plug socket, an AC voltage is converted into a DC voltage by the adaptor, and this DC voltage is applied to the DC motor, and the DC motor is driven.

However, for this kind of motor-driven massaging apparatus, it is necessary to insert the attachment plug into the plug socket when driving the apparatus, and therefore it can be used only at the place where the plug socket is provided, and an inconvenience is caused that the place of use is limited to the surrounding of the plug socket due to limitation of the cord length. Also, in performing massaging operation while grasping the operating handles, the cord is folded or twisted, causes a disconnection, and might result in a trouble.

The present invention purposes to provide a motor-driven massaging apparatus solving the above-mentioned problem at a stroke by adopting batteries for the source of driving the vibrator.

A motor-driven massaging apparatus accordance with the present invention is constituted in a manner that operating handles are projected on the both sides of a finger-pressure roller incorporating a vibrator driven with a DC voltage, and a power supply using batteries as a driving source is installed, and the above-mentioned vibrator is connected electrically to this power supply part.

In accordance with the present invention, batteries are used as the source of driving the vibrator, and therefore it is not necessary to receive power from the plug socket in driving the vibrator, and the range of use is not limited by the cord, so that massage cure can be conveniently performed anywhere. Also, a cord for connecting to the plug socket is not necessary, and therefore the problem of folding or twisting of the cord in massaging operation is eliminated, and there is no fear of trouble due to a disconnection of the cord. Then, the power supply part is installed by utilizing the operating handle, and therefore no special space for installation is required, and there is no fear of incurring complication of the construction.

THE BEST FORM FOR EMBODYING THE INVENTION

Figure 1:
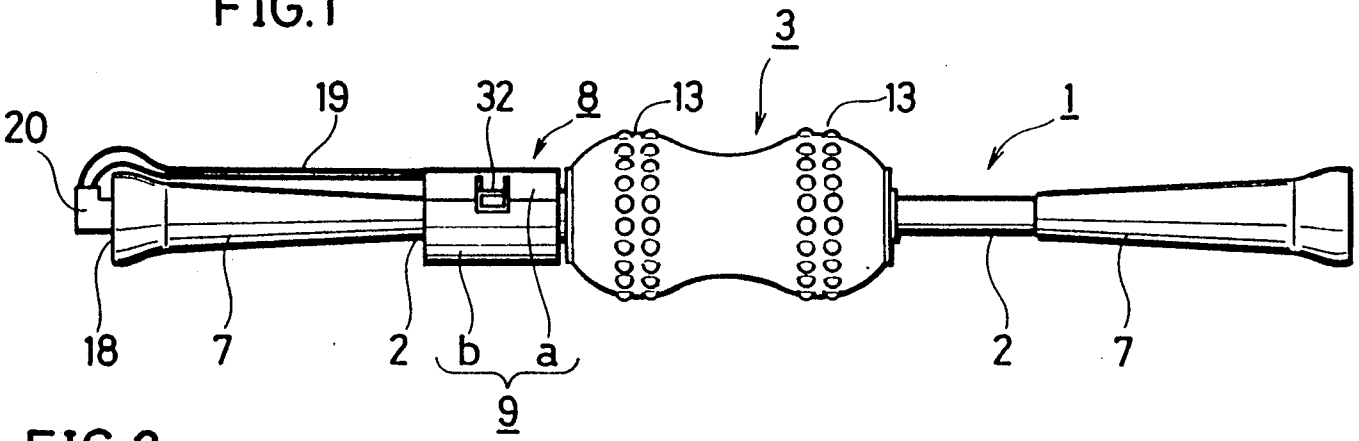
FIG. 1 is a front view showing a motor-driven massaging apparatus of one embodiment in accordance with the present invention.

FIG. 1 shows a motor-driven massaging apparatus 1 of one embodiment in accordance with the present invention.

Figure 2:
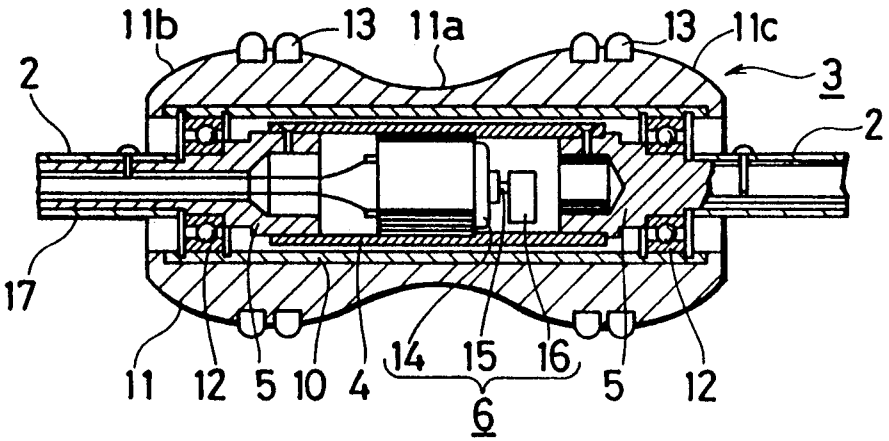
FIG. 2 is a cross-sectional view showing an internal construction of a finger-pressure roller.

This motor-driven massaging apparatus 1 is operated to massage in a manner that right and left operating handles 2 and 2 are held by hands and a center finger-pressure roller 3 is brought in contact with the body of a patient. As shown in FIG. 2, the right and left operating handles 2 and 2 are connected to both ends of a support cylinder 4 through mounting members 5 and 5, and a vibrator 6 is disposed inside the support cylinder 4, and the above-mentioned finger-pressure roller 3 is disposed rotatably around the support cylinder 4. A rubber grip 7 is fitted to the tip part of each operating handle 2, and a battery box 9 constituting a power supply part 8 is attached to one of the operating handles 2 in a manner capable of attaching/detaching and opening/closing between the grip 7 and the finger-pressure roller 3.

The above-mentioned finger-pressure roller 3 has a construction that a soft rubber pressing member 11 is fitted on the outer surface of a tubular body 10, and the abovementioned tubular body 10 is supported rotatably by bearings 12 and 12 on the above-mentioned mounting members 5 and 5. The pressing member 11 is formed in a manner that a pair of spherical bodies are connected integrally, a small diameter part **11*a* is formed at the center thereof, large-diameter parts 11*b* and 11*c* are formed on the both sides thereof, and a large number of semi-spherical protrusions 13 are formed on the peripheral surface of each of the large-diameter parts 11*b* and 11*c*** in two rows.

The above-mentioned vibrator 6 has a structure that an eccentric member 16 is attached to an output shaft 15 of a DC motor 14. When the eccentric member 16 is rotated by driving of the DC motor 14, vibration is generated attending on the eccentric rotation, and this vibration is transmitted to the finger-pressure roller 3 through the support cylinder 4, the mounting members 5 and 5, and the bearings 12 and 12. In addition, the eccentric member 16 in the illustrated example is formed in a manner that a circular or rectangular plate is attached eccentrically to the tip of the output shaft 15 of the DC motor 14, but without limited thereto, any aspect of structure may be adopted provided that the center of gravity deviates from the output shaft 15. A lead 17 is connected to the above-mentioned DC motor 14, and this lead 17 is led to the inner hole of one of the operating handles 2 through the inner hole of the mounting member 5, being connected electrically to a connecting terminal 18 installed on the tip surface of that operating handle 2.

A lead 19 is drawn out from the above-mentioned battery box 9, and a plug 20 attached to the tip of this lead 19 is inserted into the above-mentioned connecting terminal 18, and thereby a DC voltage is given from the power supply part 8 to the DC motor 14 through the connecting terminal 18.

Figure 3:
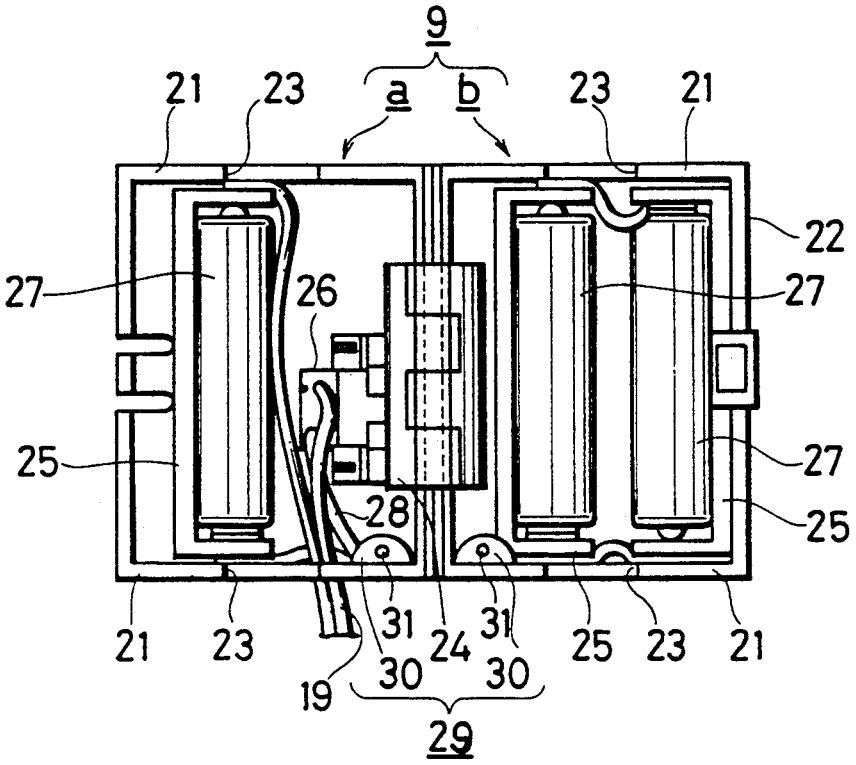
FIG. 3 is a plan view showing an opened state of a battery box of one embodiment of a power supply part.
Figure 4:
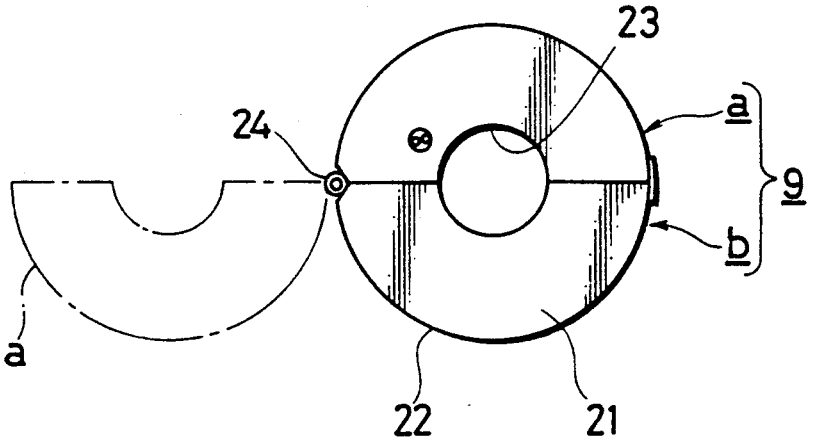
FIG. 4 is a front view showing opening and closing operation of the battery box.

As shown in FIG. 3 and FIG. 4, the battery box 9 is constituted with a cylindrical body 22 providing end plates 21 and 21 at the both ends thereof, and through holes 23 and 23 for inserting the above-mentioned operating handle 2 are drilled in the above-mentioned both end plates 21 and 21, respectively. This battery box 9 has a longitudinally-divided structure that it is divided in the radial direction of the through hole 23, and two half-cases a and b are connected in a manner capable of opening/closing by means of a hinge 24.

A plurality of battery holding frames 25 mutually connected electrically and an ON/OFF switch 26 are disposed at proper places inside each of the half-cases a and b, and a dry battery 27 is fitted in an attachable/-detachable fashion between the electrodes of the both ends of each battery holding frame 25. In addition, needless to say, the space of storing the dry batteries is set properly so as not to become an obstacle when the operating handles 2 penetrate through the above-mentioned through holes 23 and 23. Each dry battery 27 is connected in series by a lead 28 to form a power source circuit, and the output of this power source circuit is taken out through the above-mentioned lead 19, being given to the above-mentioned connecting terminal 18. The above-mentioned ON/OFF switch 26 and a contact switch 29 are inserted in this power supply circuit, and the operation part of the ON/OFF switch 26 is projected outside the case to make switching operation possible.

Figure 5:
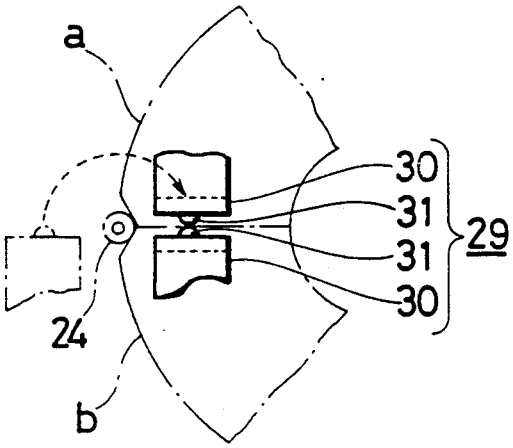
FIG. 5 is an explanatory view showing operation of a contact switch installed in the battery box.

The above-mentioned switch 29 is constituted with a pair of contact pieces 30 and 30 disposed at the butting portion of each of the half-cases a and b, and semi-spherical contact parts 31 and 31 are installed in a manner of protruding outward. Each of the contact pieces 30 and 30 is fixed to the position of opening of each of the half-cases a and b of the hinge 24 side, and as shown in FIG. 5, the contact parts 31 and 31 contact or part corresponding to closing or opening operation of the half-cases a and b.

Figure 6:
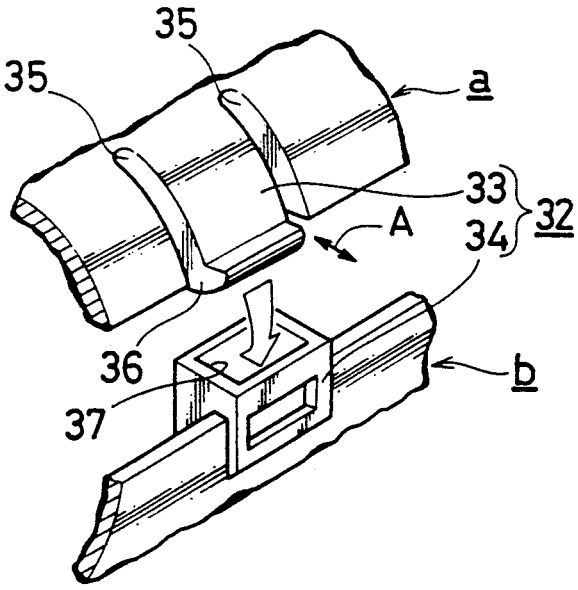
FIG. 6 is a perspective view showing a locking mechanism of the battery box in an enlarged fashion.

As shown in FIG. 6, a locking mechanism 32 consisting of an engaging piece 33 and an engaging hole 34 is installed between the above-mentioned half-cases a and b.

These engaging piece 33 and engaging hole 34 are installed in the opening of each of the half-cases a and b opposite to the hinge 24, and on the both sides of the engaging piece 33, cut grooves 35 and 35 are formed to make it possible to displace the engaging piece 33 in the direction as shown by an arrow in the figure. Thus, when the half-cases a and b are close, a hooked part 36 on the tip of the engaging piece 33 engages the engaging hole 34 from inside from a catch mouth 37, and when the half-cases a and b are opened, by pressing the engaging piece 33, the engagement of the hooked part 36 with the engaging hole 34 is released, and the engaging piece 33 gets out from the catch mouth 37.

Figure 7:
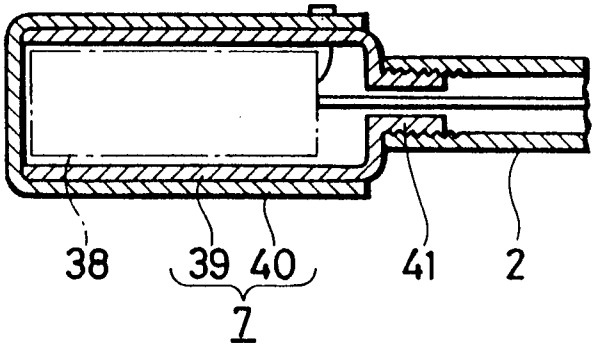
FIG. 7 is a cross-sectional view showing another embodiment of the power supply part.

In the above-mentioned embodiment, the power supply part 8 is formed by mounting the battery box 9 on the operating handle 2 from outside, but without limiting to this form, as shown in FIG. 7, it is also possible to form a dry battery storing part 38 inside the grip 7 of the operating handle 2. In the case of the embodiment in FIG. 7, the grip 7 is constituted by covering a rubber cover 40 over the main body 39, and one end of the main body 39 is opened so that the dry batteries can be inserted or detached, and the other end of the main body 39 is provided with a connecting cylinder 41, and is screwed into the inner hole of the operating handle 2.

In addition, in the above-mentioned embodiment, dry batteries are used for the DC power source, but storage batteries may be used without limiting to dry batteries.

UTILIZABILITY IN INDUSTRIES

Before applying massaging cure, the battery box 9 storing the dry batteries 27 is mounted on the operating handle 2, and the plug 20 attached to the tip of the lead 19 is connected to the connecting terminal 18. In mounting this battery box 9, the half-cases a and b are opened, and the operating handle 2 is positioned at the through holes 23 and 23 of one of the half-cases a and b, and thereafter the half-cases a and b are closed, and thereby the closed state is held by the locking mechanism 32, and the battery box 9 is disposed in position on the operating handle 2. Also, the contacts 31 and 31 of the contact switch 29 are brought in contact with each other to conduct a current by closing the half-cases a and b, and the power source circuit is put in the state that can be energized. When the ON/OFF switch 26 is turned on in this state, a DC voltage is applied to the DC motor 14 from the dry batteries 27 through the connecting terminal 18, and driven by the DC motor 14, the eccentric member 16 is rotated in an eccentric fashion to generate vibration.

Figure 8:
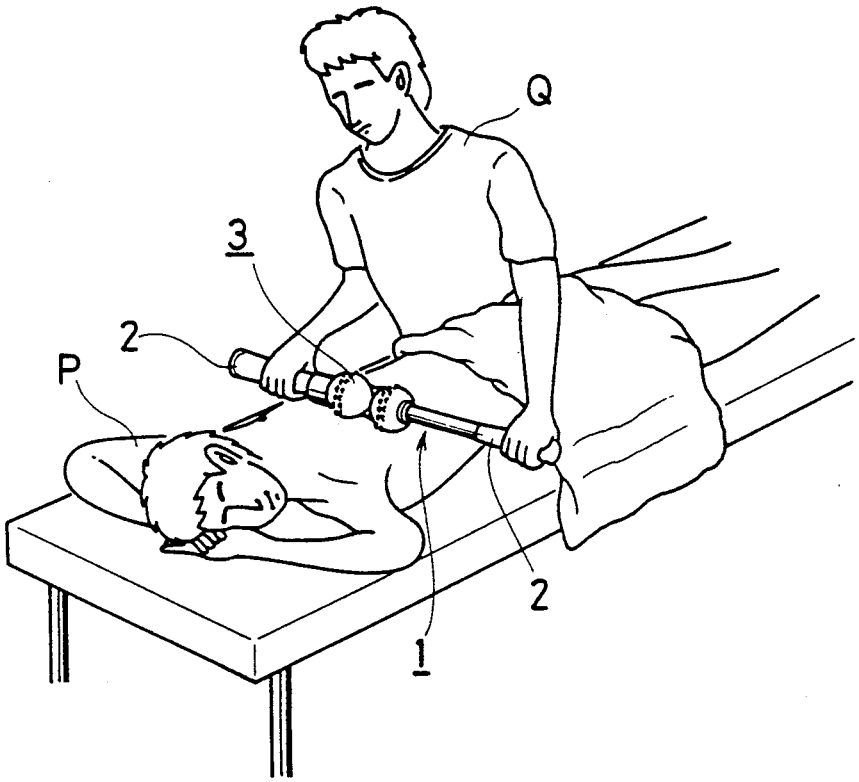
FIG. 8 is an explanatory view showing a state of using the motor-driven massaging apparatus.

FIG. 8 shows a method of using this motor-driven massaging apparatus 1. First, a patient P is laid on his face, a massagist Q grasps the grips 7 and 7 of the operating handles 2 and 2, and puts the finger-pressure roller 3 on the back of the patient P. At this time, the small-diameter part 11*a* at the center of the finger-pressure roller 3 is positioned just on the backbone, and the massagist Q rolls the finger-pressure roller 3 along the backbone while acting a moderate pushing pressure on the motor-driven massaging apparatus 1 in this state. By these rolling and vibration of the finger-pressure roller 3, the muscles along the backbone are unfastened, and effective massage can be performed, and further the protrusions 13 on the finger-pressure roller 3 can stimulate the "TSUBO" points * and the like, and thereby more effective massage can be performed.

* Points effective for relief

What is claimed is:

1. A motor-driven massage apparatus comprising a pressure roller means, a motor-driven vibrator disposed in said roller means for effecting vibration of said roller means, said roller means having a longitudinal axis extending between two longitudinal ends, elongated handles extending from each longitudinal end of said roller means, each of said handles having a handle axis aligned with said longitudinal axis of said roller means, and a battery box means detachably mounted on one of said handles juxtaposed to said roller means, said battery box means housing a battery means for driving said motor driven vibrator, wherein said battery box means comprises a generally cylindrical body having an internal axial passage, said one handle extending through said axial passage.

2. A motor-driven massage apparatus according to claim 1, wherein said battery box means is detachably mounted on the outside of said one handle.

3. A motor-driven massage apparatus according to claim 1, wherein said cylindrical body comprises two half body parts, pivot means pivotably mounting said two half body parts on one another about a pivotal axis spaced from and parallel to said longitudinal axis of said roller means.

4. A motor-driven massage apparatus according to claim 3, wherein said two half body parts have locking means for locking said two half body parts in a closed position in which said two half body parts mate to form a cylinder, said locking means being releasable to permit said two half body parts to be relatively pivoted about said pivot means from said closed position to an open position.

5. A motor-driven massage apparatus according to claim 4, wherein said locking means comprises means defining an engaging opening in one of said half body parts, said locking means further comprising an engaging piece formed between two spaced grooves in said other half body part, said engaging opening receiving said engaging piece to lock said two half body parts in said closed position.

6. A motor-driven massage apparatus according to claim 5, wherein said means defining said engaging opening comprises a structure having a mouth receiving said engaging piece, said mouth having a side wall, an engaging hole in said side wall, said engaging piece having an end formed with a hooked part which is received in said engaging hole when said two half body parts are locked in said closed position.

7. A motor-driven massage apparatus according to claim 4, further comprising electrical contact means on each half body part, said electrical contact means on each body part making electrical contact when said two half body parts are in said closed position, said electrical contact means being separated from one another when said two half body parts are pivoted about said pivot means from said closed position to said open position.

8. A motor-driven massage apparatus according to claim 1, wherein said battery means comprises a plurality of batteries disposed in said battery box means, each of said plurality of batteries being disposed externally of said one handle.

9. A motor-driven massage apparatus according to claim 1 further comprising electrical connecting means extending between said battery box means and said motor driven vibrator, said electrical connecting means comprising one electrical lead part within said one handle and another electrical lead part externally of said one handle.

10. A motor-driven massage apparatus according to claim 9, wherein said one handle has a longitudinal end, said electrical connecting means further comprising an electrical connecting terminal in said longitudinal end, an electrical plug insertable into said connecting terminal, said connecting terminal being connected to said one electrical lead part within said one handle, said plug being connected to said other electrical lead part externally of said one handle.

* * * * *